US006031333A

United States Patent [19]

Simpson

[11] Patent Number: 6,031,333

[45] Date of Patent: Feb. 29, 2000

[54] COMPACT MICROWAVE LAMP HAVING A TUNING BLOCK AND A DIELECTRIC LOCATED IN A LAMP CAVITY

[75] Inventor: James E. Simpson, Gaithersburg, Md.

[73] Assignee: Fusion Lighting, Inc., Rockville, Md.

[21] Appl. No.: 08/945,259

[22] PCT Filed: Apr. 22, 1996

[86] PCT No.: PCT/US96/05556

§ 371 Date: Oct. 20, 1997

§ 102(e) Date: Oct. 20, 1997

[87] PCT Pub. No.: WO96/33509

PCT Pub. Date: Oct. 24, 1996

[51] Int. Cl.[7] ..... H01J 65/04

[52] U.S. Cl. ..... 315/39; 315/248

[58] Field of Search ..... 315/39, 248, 267, 315/344

[56] References Cited

U.S. PATENT DOCUMENTS

| | | | |
|---|---|---|---|
| 4,002,949 | 1/1977 | McNeill et al. | 315/39 |
| 4,673,846 | 6/1987 | Yoshizawa et al. | 315/39 |
| 4,887,192 | 12/1989 | Simpson et al. | 315/39 |
| 4,902,935 | 2/1990 | Wood | 315/248 |
| 4,954,756 | 9/1990 | Wood et al. | 315/39 |
| 4,975,625 | 12/1990 | Lynch et al. | 315/39 |
| 4,990,829 | 2/1991 | Christensen | 315/39 |
| 5,448,135 | 9/1995 | Simpson | 315/39 |
| 5,786,667 | 7/1998 | Simpson et al. | 315/39 |

FOREIGN PATENT DOCUMENTS

| | | | |
|---|---|---|---|
| 0 153 745 | 9/1985 | European Pat. Off. | H01J 65/04 |
| 6151077 | 5/1994 | Japan . | |
| 93/21655 | 10/1993 | WIPO | H01J 16/38 |

*Primary Examiner*—Benny T. Lee

[57] ABSTRACT

A microwave lamp having a compact structure utilizing a coupling slot which has a dielectric member extending therethrough and a tuning block adjoining the coupling slot. A non-conventional waveguide is used which has about the width of a WR-284 waveguide and about the length of a WR-340 waveguide.

10 Claims, 3 Drawing Sheets

COMPACT MICROWAVE LAMP HAVING A TUNING BLOCK AND A DIELECTRIC LOCATED IN A LAMP CAVITY

This application has been filed under 35 U.S.C 371 based on PCT Application No. PCT/US96/05556, filed Apr. 22, 1996, which has priority based on U.S. patent application Ser. No. 426,603, filed Apr. 21, 1994, now abandoned.

The United States Government has certain rights to the subject matter described herein under an award from the Department of Energy.

BACKGROUND OF THE INVENTION

The present invention relates to a microwave powered lamp, and particularly to such a lamp which has a compact structure.

Recently, microwave powered lamps utilizing sulfur or selenium based fills for efficiently radiating in the visible region have been disclosed. For example, see U.S. Pat. No. 5,404,076, issued Apr. 4, 1995, which is incorporated herein by reference.

Such microwave lamps may be used as illumination sources, which find a particular use in commercial or industrial lighting. For such lighting applications, it is desirable to build a lamp system which fits within the general outline of some of the lamps already in existence. Many of these are equipped with rather large inductive ballasts which are installed in overhead locations adjoining the associated lamp. Accordingly, a new lamp system will have greater utility if it occupies a package of comparable size which can be similarly placed. This requires the various parts of the electrodeless lamp system to be kept as small as reasonably possible. These parts include a quartz bulb to contain the arc plasma housed within a microwave cavity having a metal mesh to contain the microwaves but allow the escape of light, a magnetron to produce the microwaves, a waveguide to carry the microwaves from the magnetron to the cavity, a power supply to drive the magnetron and cooling fans or other means to cool the magnetron and its power supply. The lamp bulb is rotated within the microwave cavity to stabilize the discharge which adds a motor to the system as well.

To increase the versatility of the new lamp and, therefore, the number of sites in which it can be used, the lamp itself does not include a reflector. Rather the lamp is to be inserted through a hole in reflectors of several designs, suitable for use in applications requiring light dispersal over different areas. This requires the light source to extend outward from the lamp case a distance of at least 100 mm. Keeping the entry hole to a small diameter increases the efficiency of the reflector.

It is desirable to keep the overall length of the lamp as small as possible. Since the motor which rotates the bulb must be placed outside of microwave fields, it potentially adds length to the lamp system. In one such configuration, the bulb stem is fed through the coupling slot and the waveguide, and the motor and coupler are located on the other side of the waveguide, resulting in a very long stem which is subject to breakage.

A further problem is encountered in that the waveguide must have a sufficiently narrow width so that the cutoff frequency is high enough to eliminate spurious interference signals from being generated, but must have a height sufficient to prevent arcing at the location of the magnetron antenna. A conventional WR-284 waveguide is narrow enough to eliminate interference signals, but because of its height which correlates to its width in a conventional ratio of about 1 to 2, arcing results.

SUMMARY OF THE INVENTION

It is thus an object of the invention to provide a microwave powered illumination lamp having a compact structure.

It is a further object of the invention to provide a microwave powered illumination lamp wherein the stem supporting the bulb is not very long.

It is still a further object of the invention to provide a lamp in which arcing is obviated.

In accordance with a first aspect of the invention, a microwave lamp is provided wherein the coupling slot is located in the cavity end wall to one side of center, while the bulb stem passes through the end plate to the other side of center and is at an angle of other than 90° in relation to the end wall, so that the bulb is supported centrally in relation to the cavity wall structure. A motor and shaft coupling to the bulb stem are located at the end of the stem outside the cavity. In this manner, the bulb stem which is provided is not particularly long, and therefore provides a more rugged and durable support structure.

In accordance with a further aspect of the invention, the waveguide which feeds the coupling slot is oriented so that its longitudinal dimension is parallel to the cavity end wall, thus minimizing the overall length of the lamp.

In accordance with a still further aspect of the invention, a novel waveguide structure is used, wherein the waveguide has about the height of a WR-340 waveguide, while it has the width of a WR-284 waveguide. In this way, the height of the magnetron antenna is accommodated without arcing, while spurious signals which might cause interference are eliminated.

BRIEF DESCRIPTION OF THE DRAWINGS

The invention will be better understood by referring to the accompanying drawings, wherein.

DETAILED DESCRIPTION OF THE PREFERRED EMBODIMENTS

Figure 1:
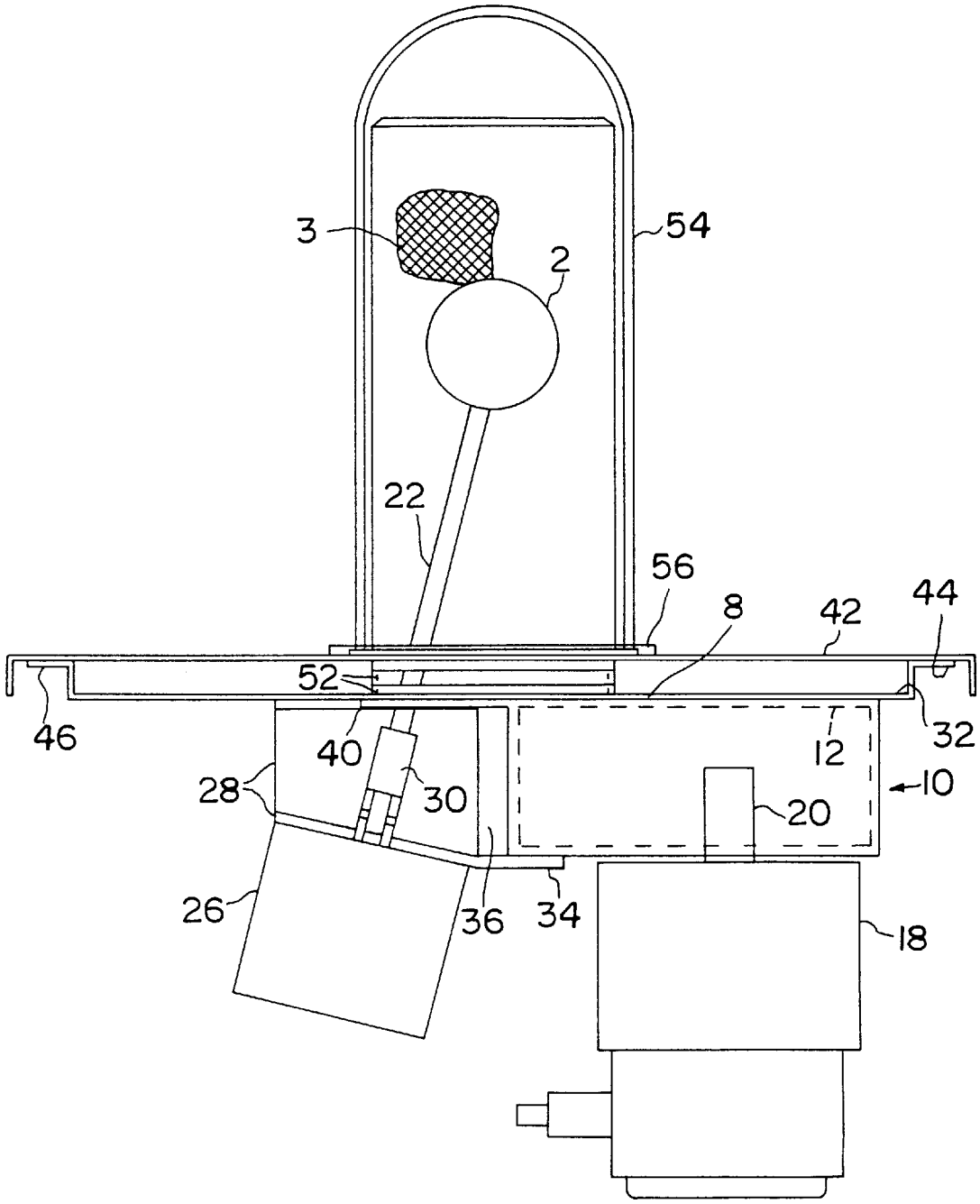
FIG. 1 is a side view of a lamp in accordance with an embodiment of the invention.

Referring to FIG. 1, a lamp in accordance with an embodiment of the invention is shown. The lamp is comprised of bulb 2 which is located in a microwave cavity. The bulb may be made of quartz and encloses a discharge forming medium, for example, a sulfur or selenium based fill.

The microwave cavity is cylindrical, and is comprised of a side wall structure, and two end walls. The side wall structure and top end wall in the orientation of FIG. 1 are made of a cylindrical metallic mesh, shown in part at reference numeral 3, which allows light to exit but is substantially opaque to microwave radiation. The bottom end wall of the cavity in the orientation of FIG. 1 is the outside surface 8 of waveguide 10.

As mentioned above, the microwave lamp depicted in FIG. 1 may be used to replace existing non-microwave lamps, and it is therefore desirable for the lamp to be made as compact as possible so as to fit within the general outline of existing lamps.

In some microwave lamps of the prior art wherein the bulb stem extends from an end wall, it passes through the waveguide which feeds the cavity, and the motor and coupling ferrule are mounted on the opposite side of the waveguide, far enough away to be clear of microwave fields. Such an arrangement, however, may have the effect of increasing the overall length of the lamp, as well as the length of the bulb stem, thereby making it subject to breakage.

In accordance with the present invention, the coupling slot is located to one side of center in the cavity end wall, while the bulb stem is fed through the end wall to the other side of center canted in relation to the end wall, with the motor and ferrule being mounted outside the cavity and away from the waveguide. Additionally, the longitudinal direction of the waveguide extends parallel to the end wall of the cavity, so as to not extend the length of the lamp. The result is a more compact lamp of shorter overall length, wherein the bulb is more ruggedly supported on a shorter stem.

Figure 2:
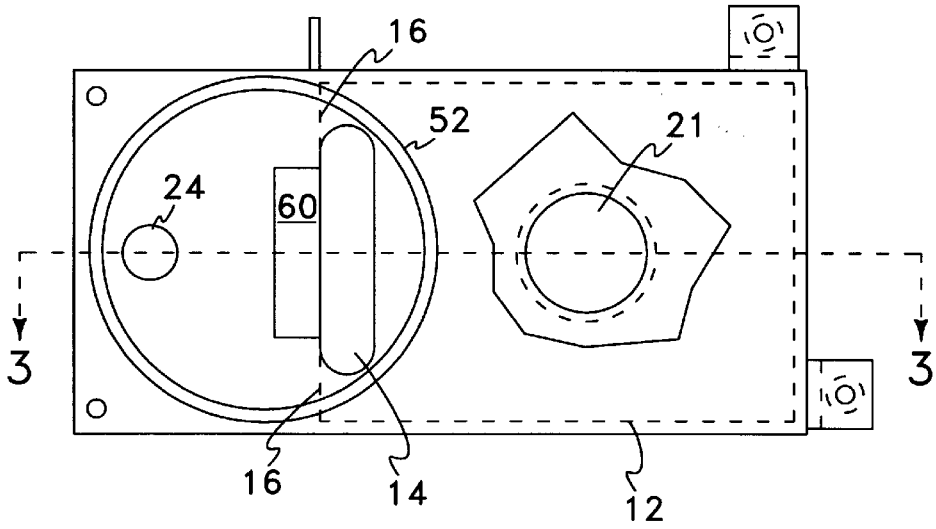
FIG. 2 is a top view of the waveguide portion of the lamp depicted in FIG. 1.

Referring to FIGS. 1 and 2, rectangular waveguide 10 is shown, having inside wall 12 and outside wall 8 (see FIG. 1). The top walls of the waveguide have coupling slot 14 therein, which is shown in FIG. 2. As is also shown in FIG. 2, end wall 16 of the waveguide is slightly wider than the coupling slot 14.

Returning to FIG. 1, magnetron 18 having antenna 20 is mounted to the waveguide, as shown. Microwave power is fed into the waveguide and through coupling slot 14 (see FIG. 2) to the microwave cavity, where it excites the fill in bulb 2. In FIG. 2, hole 21 is shown, through which the magnetron antenna and a gasket protrude.

Referring to FIG. 1, bulb stem 22 is passed through hole 24 at (see FIG. 2) an angle of other than 90°, (about 77° in the preferred embodiment) so that the bulb is centrally located in relation to the mesh side wall structure of the cavity. The motor 26 is mounted to motor support 28, while ferrule 30 couples the motor shaft to the bulb stem, which is typically made of quartz. Extension 34 of support 28 is secured to the bottom outside surface of the waveguide, while gap 36 is present between the motor support and the end wall of the waveguide.

In FIG. 1, the top wall 8 of the waveguide extends to the left at reference numeral 40 past the end of the waveguide. Additionally, the top of the waveguide is flush against plate 32, which is secured to plate 42 at the ends thereof with flanges 44 and 46. Referring to FIGS. 1 and 2, metallic ring 52 is mounted on the top surface of the waveguide (cavity end). The cylindrical mesh is secured to this ring by a clamp, and the mesh passes through a hole in plate 42. As shown in FIG. 1*a* cylindrical envelope 54 which may be made of glass or quartz surrounds the screen, and is mounted on plate 42, for example by retainer 56. Thermal insulation is disposed in the space between plates 32 and 42.

In the operation of the lamp, microwave power generated by the magnetron is fed through the waveguide and the coupling slot into the cavity in which bulb 2 is located. In order to make the device as compact as possible and to provide a stable relationship between the magnetron and the cavity, magnetron antenna 20 is located ¼ guide wavelength (the wavelength of signals propagating within the waveguide) from coupling slot 14.

Additionally, it was found that a waveguide having a width sufficiently narrow to have a cut-off frequency sufficiently high to eliminate spurious signals was necessary. For example, a waveguide was tried which accommodated the magnetron antenna produced out of band signals 200 Mhz below the normal operation point of 2450 Mhz, and the use of the ¼ wavelength waveguide length referred to above tends to aggravate this situation. It was found that a WR-284 (equivalent IEC designation, R-32) waveguide was sufficiently narrow to eliminate spurious signals, but it was found that the height of this waveguide was too small to accommodate the magnetron antenna without arcing. To solve this problem, a non-conventional waveguide was used having about the width of the WR-284 waveguide and about the height of the WR-340 (equivalent IEC designation, R-26) waveguide. This blocks the transmission of signals below 2078 Mhz and helps to suppress the low frequency out of band signals by reducing the phase shift between the magnetron and the coupling slot. At the same time, the height of the waveguide is sufficient to accommodate the magnetron antenna without arcing.

The waveguide end wall behind the magnetron is moved farther away than is the usual practice. In prototype testing, a metal tuning knob was used to match the impedance of the lamp to the waveguide. This knob functioned as a capacitor at its location. With the length reduction to one quarter wavelength, this position became the same as the magnetron antenna. A tuning knob might have been placed beside the antenna, taking care to avoid arcing, however, the magnetron antenna itself is a capacitor across the waveguide. This is usually compensated by placing the end wall in an inductive position, closer to the antenna than a quarter wavelength. By moving the wall farther out, the inductance is reduced and the antenna is seen as the desired tuning capacitance. The best position was found experimentally by using a movable waveguide end wall.

In many previous microwave lamps, matching is accomplished by placing a tuning knob in the waveguide. If all possible load phases are to be corrected, a half-wavelenth of waveguide is needed. According to the invention, the system was matched by placing a thin tuning block 60 inside the microwave cavity, shown in FIG. 2, beside the slot 14 to modify the current path. For example, block 60 may comprise a fixed metallic tuning member adjacent to the slot 14.

Figure 3:
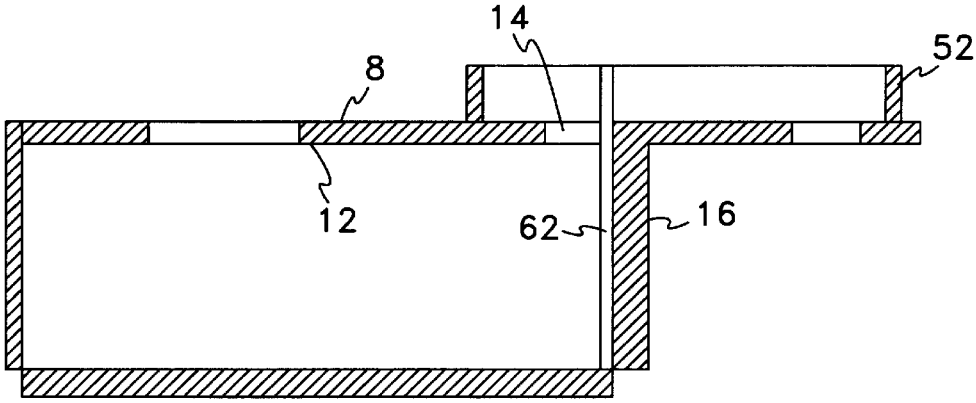
FIG. 3 is a sectional view of the waveguide of the lamp of FIG. 1 taken perpendicular to the coupling slot along section line 3—3 in FIG. 2.
Figure 3A:
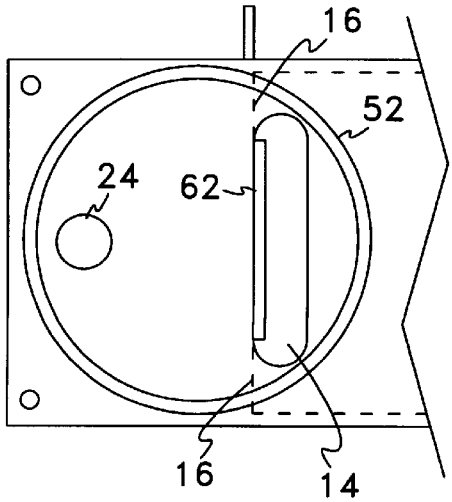
FIG. 3A is a top, fragmented view of the waveguide showing a dielectric member substantially as wide as the coupling slot.

Referring to FIG. 3, which is a view as seen from the back of the lamp in FIG. 1 (left to right reversed), dielectric member 62, which may be made of mica is depicted. This member is secured, for example, against the inside end wall 16 of the waveguide and protrudes through coupling slot 14 while contracting the edge of the slot. It may be substantially as wide as the slot (see FIG. 3A). The purpose of member 62 is to prevent arcing across the slot. Elements 8, 12, and 52 reference like numbered elements previously described.

Figure 4:
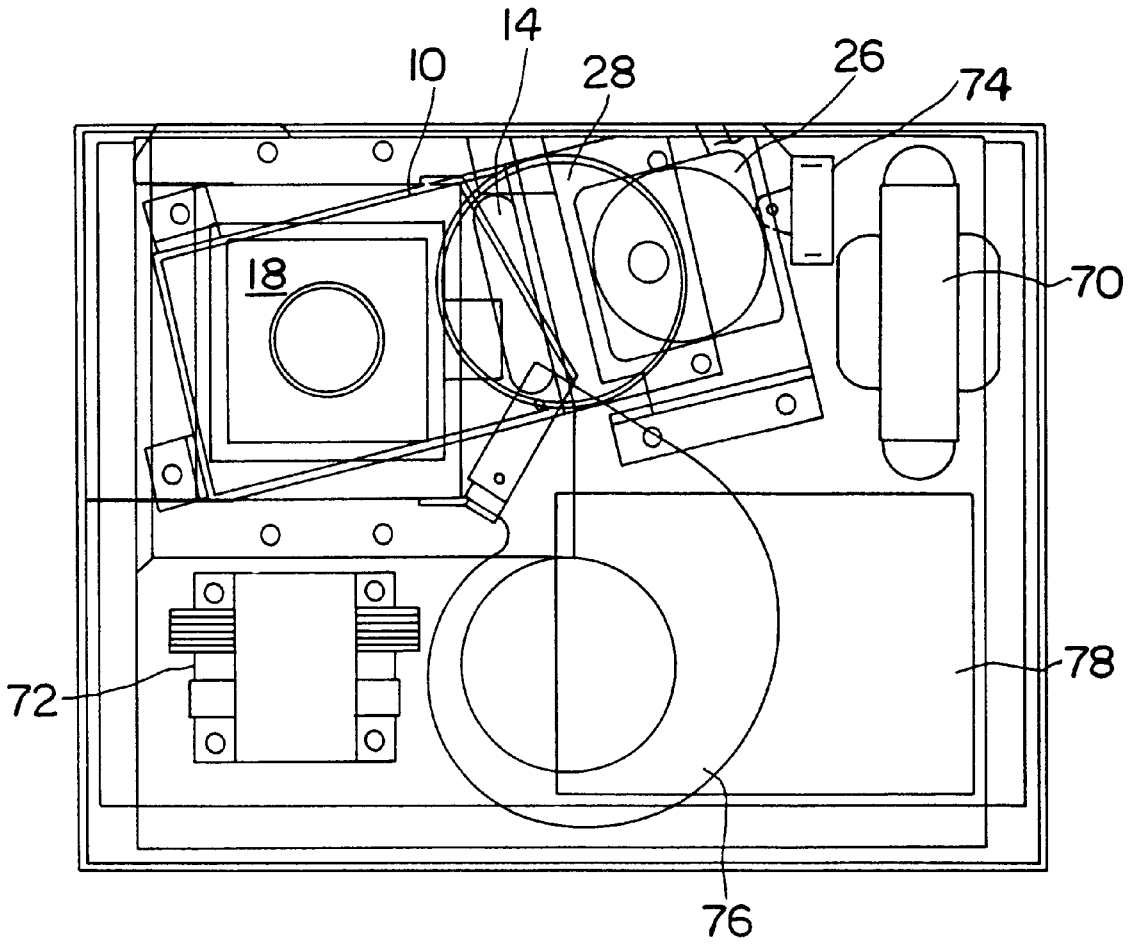
FIG. 4 is a plan view which depicts how the magnetron and associated components are mounted in the lamp of FIG. 1.

FIG. 4 is a plan view of the magnetron and associated components, which are located on plate 32 shown in FIG. 1.

As seen in FIG. 4, the magnetron 18 receives filament power from filament transformer 70, while stepdown transformer 72 may be used to provide power for bulb rotator motor 26, shown in connection with motor mount 28 and capacitor 74. In FIG. 4, magnetron cooling air blower 76 is depicted as is PC control board 78. Finally, waveguide 10 is shown feeding coupling slot 14.

While the invention has been described in connection with a preferred embodiment, variations will occur to those skilled in the art, and it is therefore understood that the invention herein is defined in the claims which are appended hereto.

I claim:

1. An electrodeless lamp, comprising:

a microwave cavity having a light-transmissive portion;

a bulb disposed in the microwave cavity, the bulb containing a discharge forming fill;

a source of microwave power;

a waveguide coupled to the source of microwave power, the waveguide including a slot in a wall of the waveguide for coupling the microwave power to the microwave cavity; and a tuning block positioned inside the microwave cavity adjoining the slot.

2. The electrodeless lamp as recited in claim 1, wherein the tuning block comprises a fixed metallic tuning member.

3. An electrodeless lamp, comprising:

a microwave cavity having a light-transmissive portion;

a bulb disposed in the microwave cavity, the bulb containing a discharge forming fill;

a source of microwave power;

a waveguide coupled to the source of microwave power, the waveguide including a slot in a wall of the waveguide for coupling the microwave power to the microwave cavity; and a dielectric member positioned against an end wall of the waveguide and extending into the microwave cavity along an edge of the slot.

4. The electrodeless lamp as recited in claim 3, wherein the end wall of the waveguide is substantially aligned with the edge of the slot, and wherein the dielectric member extends through the slot and is secured to the end wall of the waveguide.

5. The electrodeless lamp as recited in claim 3, wherein the dielectric member is comprised of mica.

6. The electrodeless lamp as recited in claim 3, wherein the dielectric member has a width which is substantially as wide as a width of the slot.

7. A compact electrodeless lamp, comprising:

a microwave cavity having a light-transmissive portion;

a bulb disposed in the microwave cavity, the bulb containing a discharge forming fill;

a magnetron for providing microwave power, the magnetron having an antenna;

a waveguide connected to the magnetron so that the antenna of the magnetron extends inside the waveguide, the waveguide including a slot in a wall of the waveguide for coupling the microwave power to the microwave cavity, wherein the distance between the antenna and the slot is about ¼ guide wavelength, and wherein the waveguide has a width which is sufficiently narrow to suppress out of band signals and a height sufficient to avoid arcing between the waveguide and the antenna.

8. The electrodeless lamp as recited in claim 7, further comprising a dielectric member positioned against an end wall of the waveguide and extending into the microwave cavity along an edge of the slot.

9. The electrodeless lamp as recited in claim 7, further comprising a tuning block positioned inside the microwave cavity adjacent to the slot.

10. The electrodeless lamp as recited in claim 7, wherein the width of the waveguide is about equal to a width of a WR-284 waveguide and wherein the height of the waveguide is about equal to a height of a WR-340 waveguide.

* * * * *